United States Patent [19]

Spademan

[11] 4,182,525

[45] Jan. 8, 1980

[54] STEP-IN SIDE-CLAMP SAFETY SKI RELEASE SYSTEM

[76] Inventor: Richard G. Spademan, 1421 Old County Rd., Belmont, Calif. 94002

[21] Appl. No.: 853,500

[22] Filed: Nov. 21, 1977

[51] Int. Cl.[2] ..... A63C 9/086

[52] U.S. Cl. ..... 280/624

[58] Field of Search ..... 280/624, 618, 611, 613, 280/636

[56] References Cited

U.S. PATENT DOCUMENTS

| | | | |
|---|---|---|---|
| 3,797,841 | 3/1974 | McAusland | 280/624 |
| 3,884,492 | 5/1975 | Spademan | 280/624 |
| 3,887,205 | 6/1975 | Edmund | 280/624 |
| 3,888,497 | 6/1975 | Zahradka | 280/624 |
| 3,891,227 | 6/1975 | Spademan | 280/624 |
| 3,921,995 | 11/1975 | Moog | 280/618 |
| 4,063,752 | 12/1977 | Whitaker et al. | 280/624 |

FOREIGN PATENT DOCUMENTS

| | | | |
|---|---|---|---|
| 2511332 | 9/1975 | Fed. Rep. of Germany | 280/624 |

*Primary Examiner*—David M. Mitchell
*Attorney, Agent, or Firm*—Warren M. Becker

[57] ABSTRACT

A step-in side-clamp safety ski release system is described. In the system there is provided a first assembly for mounting to the sole of a ski boot and a second assembly for mounting to the upper surface of a ski. One of the first and second assemblies comprises a plate member and the other of the first and second assemblies comprises a pair of inwardly directed facing protuberances for overlaying the plate member in a releasable engagement. In the binding there is also provided a movable overcenter mechanism. The overcenter mechanism is provided with a resilient member for providing a spring force which is movable between a clamping position for releasably, resiliently clamping the plate member and the protuberances together, and an unclamping position for voluntarily separating the plate member and the protuberances. For stepping into the ski release system with the plate member when the overcenter mechanism is in its clamping position, there is provided a recess in each of the protuberances for slidably receiving the plate member and more particularly for slidably receiving a pair of tip members extending from the lateral corners of the plate member.

5 Claims, 2 Drawing Figures

STEP-IN SIDE-CLAMP SAFETY SKI RELEASE SYSTEM

BACKGROUND OF THE INVENTION

The present invention relates to ski release bindings in general and in particular to the side-clamp safety ski release systems shown and described in applicant's U.S. Pat. No. Re. 26,972, U.S. Pat. No. 3,606,370 and U.S. Pat. No. 3,891,227.

In each of the patents referred to there is disclosed and described a ski release system comprising a pair of side-clamping members which are movable relative to a housing in opposite directions, generally perpendicular to the lateral edges thereof, a connecting member or other means which is movably coupled to the side-clamping members for moving the side-clamping members and a resilient member in an overcenter release mechanism coupled to the connecting member for applying a spring force to the side-clamping members through the connecting member. Depending on whether the movable side-clamping members are mounted in the sole of a ski boot or on the surface of the ski, there is also provided a separable plate or fixed-jaw members for use with the side-clamping members for releasably binding a ski boot and a ski. For example, in U.S. Pat. Nos. 26,972 and 3,606,370 the movable side-clamping members comprises a pair of inwardly directed facing protuberances and a plate means that is engaged by the side-clamping members is mounted to the sole of a ski boot. In U.S. Pat. No. 3,891,227 the mechanical parts are reversed and the side-clamping members comprising a pair of outwardly extending plate members are mounted in a housing to or in the bottom of a ski boot and the plate member in the form of a pair of upstanding fixed jaw members comprising a pair of inwardly directed facing protuberances for overlaying the plate members in the movable side-clamping members is mounted to the upper surface of a ski.

To open and close the side-clamping members relative to the plate member or to the fixed-jaw members described in the above patents, it is necessary to move the overcenter mechanism by hand. For example, to open the side-clamping members, it is necessary to grasp the overcenter release mechanism by hand and move it from a horizontal position in which it is applying a spring force to the side-clamping members for holding the clamping members in a releasable engagement with the plate or jaw members pivotably upwardly for releasing the spring tension on the connecting member and the side-clamping members so as to permit the side-clamping members to move from the plate or jaw members. Conversely, to enter the binding, the overcenter release mechanism must be pivoted from its vertical or raised position downwardly to a position substantially horizontal to the ski for applying the spring force to the connecting member and the side-clamping members to force the side-clamping members into releasable engagement with the plate or jaw members.

In practice, operating the overcenter release mechanism by hand to enter and leave the binding has been found to be inconvenient and often difficult. This is because a skier, in order to operate the overcenter release mechanism by hand, must either bend over and manually grasp the overcenter mechanism or use a ski pole tip to move the mechanism. With regard to the latter practice, depending on the angular position of the tension-adjusting knob at the end of the overcenter release mechanism, it is frequently difficult to insert the tip of a ski pole thereagainst without having the ski pole tip slide therefrom, there being no other means for receiving the ski pole tip provided for moving the overcenter release mechanism. Bending over and grasping the overcenter release mechanism by hand is also difficult if a skier is wearing bulky clothes. The manual operation of the overcenter release mechanism is also inconvenient and difficult while attempting to retain the relative position of the plate or jaw members and the side-clamping members. If the ski slope is steep or irregular, or the snow conditions deep or slippery, the skier must often frustratingly repeat the operation several times before successfully engaging the plate or jaw members and the clamping members.

For these reasons, it is desirable to be able to simply step into the binding to enter the binding.

SUMMARY OF THE INVENTION

In view of the foregoing, a principal object of the present invention is a step-in safety ski release system in general and in particular a step-in- side-clamping safety ski release system retaining all of the advantages of the previously patented safety ski release systems shown and described in applicant's U.S. Pat. No. Re. 26,972, U.S. Pat. No. 3,606,370 and U.S. Pat. No. 3,891,227.

In accordance with the above object, there is provided in a preferred embodiment of the present invention a step-in side-clamping safety ski release system comprising a pair of side-clamping members for mounting to the upper surface of a ski and a separable plate member for mounting to the sole of a ski boot.

Coupled to the side-clamping members for moving the side-clamping members is a connecting member and coupled to the connecting member is an overcenter lever mechanism including a resilient member for generating a spring force.

The spring force generated by the resilient member in the overcenter lever mechanism is applied to the clamping members for clamping the plate member between the clamping members when the overcenter lever mechanism is in a clamping position and is removed from the clamping members for permitting separation of the clamping members and the plate members when the overcenter lever mechanism is in its unclamping or elevated position.

The plate member which is insertable between the side-clamping members, comprises a pair of V-shaped lateral edges for forming a pair of forward tip members and a pair of rearward tip members.

In each of the protuberances of the side-clamping members there is provided a recess. The recess comprises a concave, curved surface having a midline which slopes from the top edge of the surface downwardly inwardly and forwardly or rearwardly toward the other proturberances for slidably receiving a corresponding one of the forward or rearward tip members of the plate member.

In use, as the forward or rearward tip members of the plate member are moved through the recesses in the protuberances of the side-clamping members, the resilient member in the overcenter lever mechanism forces the plate member to slide forwardly or rearwardly relative to the side-clamping members to center the plate member between the side-clamping members and to position the portions of the protuberances on opposite sides of their respective recesses over the forward and rear tip members of the plate member. Once the plate member is thus inserted between the side-clamping members with the overcenter lever mechanism in its clamping position, removal of the plate member from therebetween requires release movement of sufficient force to overcome the spring force of the resilient member in the overcenter mechanism or voluntary separation of the plate member from the side-clamping members by moving the overcenter lever mechanism from its clamping position to its unclamping position.

In an alternative embodiment, the side-clamping members comprise a pair of movable plate members and are mounted in or on the sole of a ski boot. The lateral edges of the plate members have a contour substantially identical to the contour of the separable plate member described above which is mounted to the sole of a ski boot. For mounting on the upper surface of a ski there is provided a pair of upstanding jaw-like members, each comprising an inwardly directed, facing proturberance.

As described in the preferred embodiment, each of the protuberances in the fixed jaw members is provided with a recess for receiving the forward or rearward tip members of the movable clamping members.

As will be apparent, all of the embodiments described permit a skier to step into the binding while the clamping members are in their clamping position without bending over to manipulate the mechanism by hand.

DESCRIPTION OF THE DRAWINGS

The above and other objects, features and advantages of the present invention will become apparent from the following detailed description of the accompanying drawings in which.

DETAILED DESCRIPTION

Figure 1:
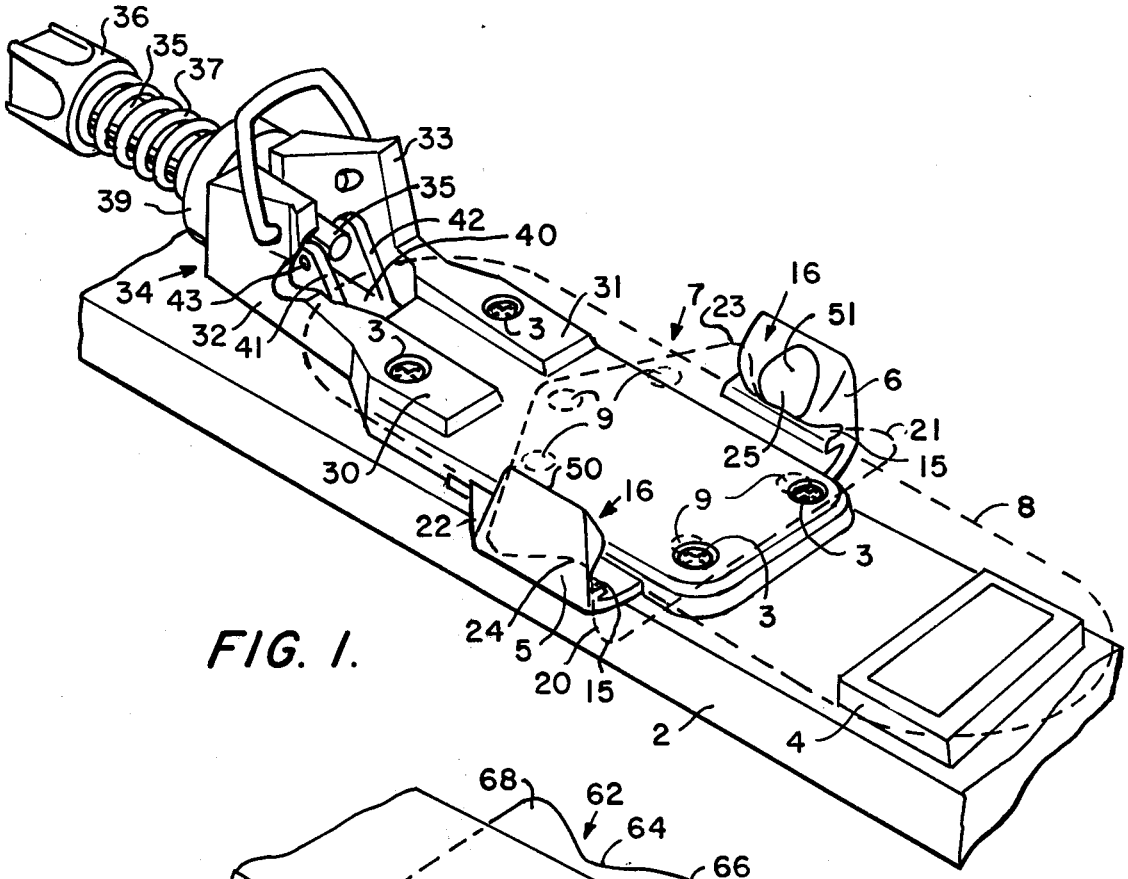
FIG. 1 is a perspective view of a preferred embodiment of the present invention.

Referring to FIG. 1, there is provided in a first embodiment of a step-in safety side-clamping ski release system according to the present invention, a housing designated generally as 1, removably mounted on a ski 2 as by a plurality of screws or the like 3. Also mounted to the ski 2, forward of the housing 1, is a conventional toeplate 4. Toeplate 4 forms no part of the present invention and accordingly is not further described. At the forward end of the housing 1 there is provided a pair of side-clamping members 5 and 6. Shown in broken lines between the side-clamping members 5 and 6, is a receiver means such as plate member 7. The plate member 7 is mounted on the under surface of the sole of a ski boot, also shown in broken lines designated 8, by means of screws or the like in a plurality of holes 9.

Each of the side-clamping members 5 and 6 comprises a shoulder portion 15 for supporting the plate member 7. Immediately above the shoulder 15 and spaced slightly therefrom is an inwardly extending overlying protuberance 16. The protuberance 16 overlies the plate 7 for preventing its slipping from between the clamping members 5 and 6 when they are in their closed position.

Along its lateral edges, which are beveled inwardly from its bottom or ski side toward its upper surface, the plate member 7 comprises a pair of forward tip members 20 and 21 and a pair of rearward tip members 22 and 23, each of which is separated by a recess or indentation 24 and 25, respectively. The particular contour of the clamping members 5 and 6 and the contour of the plate member 7, particularly the tip members 20, 21, 22, 23 and the indentations 24 and 25 along the beveled lateral edges thereof are provided for permitting release, as more fully described in the above patents.

Rearward of the clamping members 5 and 6, at the rear of the housing 1, there is provided a pair of spaced heel-step members 30 and 31 for supporting the heel of the ski boot 8. Rearward of the heel step members 30 and 31, the housing 1 is formed with a pair of spaced wall members 32 and 33. The wall members 32 and 33 are terminated by an upstanding rear wall member 34. Extending through the wall member 34, is a rod or shaft member 35. The rod or shaft member 35 extends rearwardly of the wall 34 and is terminated by an internally threaded adjusting knob 36 for adjusting the compression applied to a spring 37 disposed about the rod 35 between the knob 36 and an overcenter washer 39 at the rear of the wall 34.

Provided in housing 1 for moving the clamping members 5 and 6, and shown between the heel-supporting members 30 and 31 in FIG. 1, is a T-shaped connecting member 40, as described in the above identified U.S. Pat. No. 3,606,370. Connecting member 40 has a pair of upstanding members 41 and 42. The interior end of the rod member 35 is pivotably coupled, by means of a pin 43, to the upstanding members 41 and 42.

As thus far described, the ski release system of FIG. 1 is substantially identical to the binding described in the above referenced U.S. Pat. No. 3,606,370. The principal difference and the difference which changes the patented binding to a step-in binding is the provision of a pair of recesses 50 and 51 in the protuberances 16 of the side-clamping members 5 and 6, respectively. Each of the recesses 50 and 51 comprise a concave, curved surface, the midline of which slopes from the top edge of the surface downwardly, inwardly and forwardly or rearwardly toward the other facing protuberance. The recesses 50 and 51, when inclined forwardly, are provided for receiving the forward tips 20 and 21, respectively, of the plate 7 mounted on the sole of the ski boot 8. When the recesses 50 and 51 are inclined rearwardly, they are positioned to receive the rear tips 22 and 23.

In use, the overcenter mechanism comprising the adjusting knob 36, spring 37, overcenter washer 39 and rod 35 is pivoted downwardly to a horizontal position substantially parallel to the upper surface of the ski, as shown in FIG. 1, for applying the spring force of the spring 37 through the connecting member 40 to the side-clamping members 5 and 6, as described in the above identified U.S. Pat. No. 3,606,370. With the side-clamping members 5 and 6 located in their clamping position, a skier places the forward or rearward tips of the plate 7 in the recesses 50 and 51. At this time, if the forward tips are first inserted, the plate 7 is generally canted slightly relative to the midline of the recesses 50 and 51 by pointing the toe of the ski boot downwardly toward the ski. Alternatively, if the rear tips are first inserted, the heel of the boot is pointed downwardly toward the ski. As the tips 20 and 21 or 22 and 23 of the plate 7 are pressed through the recesses 50 and 51, the clamping members 5 and 6 are spread slightly outwardly. As the tip members 20 and 21 or 22 and 23 pass below the protuberances 16, the spring force urging the clamping members 5 and 6 together causes the plate member to slide forwardly or rearwardly for centering the plate member 7 beneath the protuberances 16 of the clamping members 5 and 6 such that the protuberances on the opposite sides of the recesses 50 and 51 overlie at least a portion of the forward and rear tip members 20, 21, 22 and 23, respectively, as shown in FIG. 1.

Figure 2:
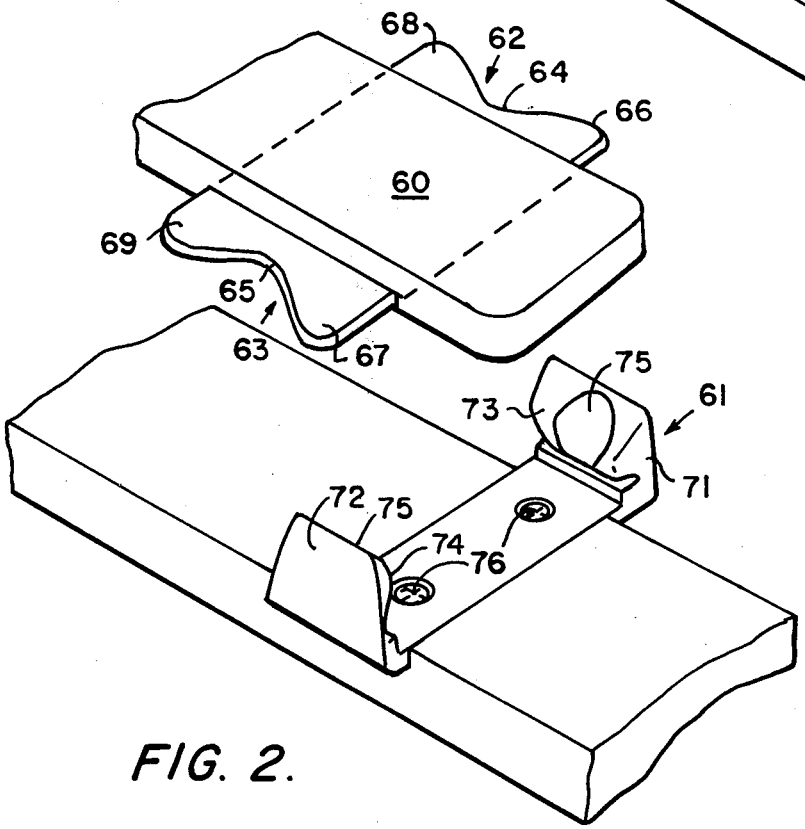
FIG. 2 is a perspective view of the pertinent parts of an alternative embodiment of the present invention.

Referring to FIG. 2, there is provided, in an alternative embodiment of the present invention, an assembly designated generally as 60 for mounting in or to the sole of a ski boot and a member 61 for mounting to the upper surface of a ski. In the assembly 60 there is provided a pair of outwardly extending, movable plate members 62 and 63. The plate members 62 and 63 are provided with a pair of beveled lateral edges 64 and 65, respectively, as well as a pair of forward tip members 66 and 67 and rearward tip members 68 and 69, respectively. The edges 64 and 65 and tips 66, 67, 68 and 69 are substantially identical to the corresponding edges and tips described above with respect to the plate member 7 except that they terminate the movable plate members 62 and 63.

In the ski-mounted member 61 there is provided a pair of spaced upstanding members 71 and 72. The members 71 and 72 comprise inwardly directed facing protuberances 73 and 74, respectively. In the facing protuberances 73 and 74 there is provided a recess 75, the midline of which slopes from the top edge of the surface downwardly, inwardly and forwardly or rearwardly toward the other protuberance. The recesses 75 are provided for slidably receiving the tip members 66 and 67 or 68 and 69 at the edges of the plate members 62 and 63 of the assembly 60. Between the members 71 and 72 there is provided a means, such as holes, 76, for mounting the member 61 to the upper surface of a ski.

In use, as described above with respect to the embodiment of FIG. 1, the movable side-clamping members 62 and 63 are placed in their clamping position by a suitable positioning of an appropriate overcenter mechanism. With the side-clamping members 62 and 63 in their clamping position, the forward tip members 66 and 67 or rearward tip members 68 and 69 are inserted in the recesses 75 of the upstanding members 71 and 72 of the ski-mounted member 61. As the tip members 66 and 67 or 68 and 69 are pressed into the recesses, the side-clamping plate members 62 and 63 are urged inwardly until such time as they clear the protuberances 73 and 74, at which time the spring force urging the clamping members 62 and 63 apart causes the clamping members to move slidably forwardly or rearwardly, centering the clamping members beneath the protuberances on opposite sides of the recesses 75.

Two embodiments of a step-in safety ski release system according to the present invention are described. It is contemplated, however, that other changes will occur to those skilled in the art and can be made to the embodiments described without departing from the spirit and scope of the present invention. For example, instead of having the recesses in the facing protuberances 16 of FIG. 1 or 73 and 74 of FIG. 2, the recesses described above with respect to FIGS. 1 and 2, may be incorporated in plate members corresponding to the plate members 7 and 62 and 63 of FIGS. 1 and 2. If the recesses are incorporated in the plate members 7 and 62 and 63, the protuberances 16, 73 and 74 are provided with corresponding and complementary shapes for slidably engaging the recesses. It is intended, therefore, that the scope of the invention not be limited to the embodiments described but be determined by reference to the claims hereinafter provided and their equivalents.

What is claimed is:

1. In a ski binding having a movable clamping member and a clamp-receiving member, including means forming a protuberance and means for engaging said protuberance, said protuberance-engaging means having an edge terminated at each end by an outwardly extending portion forming tip members for releasably engaging said protuberance and a surface which extends inwardly from said tip members toward the midline of said protuberance-engaging means for positioning said protuberance-engaging means relative to said protuberance when said protuberance-engaging means is engaged by said protuberance, an improvement for converting said binding to a step-in binding comprising: a recess extending in a generally vertical direction disposed in said protuberance for receiving one of said tip members as a skier moves said protuberance-engaging means past said protuberance when entering the binding for releasable engagement therewith, said recess serving as a camming surface for moving the movable clamping member as one of said tip members is pressed downwardly through said recess when a ski boot is inserted in said binding.

2. An improvement according to claim 1 wherein the recess in said protuberance for receiving said tip member comprises a concave, curved surface, the midline of which slopes from the top edge of the surface downwardly and inwardly toward the midline of the binding.

3. An improvement according to claim 1 wherein said plate member is located beneath said protuberance and said protuberance overlays at least portions of said forward and rearward tip members when said plate member and said protuberance are engaged.

4. An improvement according to claim 1 wherein said protuberance-engaging means comprises a plate member and said tip members extend laterally from the forward and rear edges of said plate member.

5. An improvement according to claim 4 wherein said plate member is mounted on or in the sole of a ski boot rearward of the toe and forward of the rear of the heel thereof for engagement with said protuberance.

* * * * *